US008959806B2

(12) United States Patent
Zamorano Jones

(10) Patent No.: US 8,959,806 B2
(45) Date of Patent: Feb. 24, 2015

(54) ROLLED STEEL LIP FOR AN EXCAVATOR BUCKET

(71) Applicant: Minetec S.A., Renca, Santiago (CL)

(72) Inventor: Claudio Zamorano Jones, Renca (CL)

(73) Assignee: Minetec S.A., Santiago (CL)

( * ) Notice: Subject to any disclaimer, the term of this patent is extended or adjusted under 35 U.S.C. 154(b) by 0 days.

(21) Appl. No.: 13/709,665

(22) Filed: Dec. 10, 2012

(65) Prior Publication Data

US 2013/0145660 A1 Jun. 13, 2013

(30) Foreign Application Priority Data

Dec. 9, 2011 (CL) ..... CL 3127-2011

(51) Int. Cl.
*E02F 9/28* (2006.01)
*E02F 9/00* (2006.01)

(52) U.S. Cl.
CPC ..... *E02F 9/00* (2013.01); *E02F 9/2825* (2013.01); *E02F 9/285* (2013.01); *E02F 9/2883* (2013.01)
USPC ..... 37/450; 37/446; 37/453; 37/460

(58) Field of Classification Search
USPC ..... 37/446, 449, 450, 451, 452, 453, 454, 37/460
See application file for complete search history.

(56) References Cited

U.S. PATENT DOCUMENTS

| | | | | | |
|---|---|---|---|---|---|
| 3,160,967 | A * | 12/1964 | Nichols | 37/446 |
| 3,550,293 | A * | 12/1970 | Helton | 37/450 |
| 3,621,594 | A * | 11/1971 | Hahn et al. | 7/451 |
| 4,407,081 | A * | 10/1983 | Hanson | 37/454 |
| 4,833,801 | A * | 5/1989 | Winter | 37/270 |
| 4,939,855 | A * | 7/1990 | McCreary, Jr. | 37/444 |
| 5,526,592 | A * | 6/1996 | Bierwith | 37/451 |
| H002020 | H * | 5/2002 | Kesavan et al. | 37/455 |
| 6,990,760 | B1 * | 1/2006 | Zaayman et al. | 37/446 |
| 7,266,914 | B2 * | 9/2007 | Grant | 37/446 |
| 7,874,085 | B1 * | 1/2011 | Winter et al. | 37/270 |
| 8,024,874 | B2 * | 9/2011 | McClanahan et al. | 37/452 |
| 8,240,070 | B1 * | 8/2012 | Phillips et al. | 37/444 |
| 2003/0061744 | A1 * | 4/2003 | Leslie et al. | 37/452 |
| 2004/0107608 | A1 * | 6/2004 | Meyers et al. | 37/452 |
| 2009/0278372 | A1 * | 11/2009 | Liebert | 296/39.1 |
| 2009/0307944 | A1 * | 12/2009 | Buckbee | 37/266 |
| 2010/0162594 | A1 * | 7/2010 | Bierwith | 37/450 |
| 2011/0162241 | A1 * | 7/2011 | Wangsness | 37/266 |

* cited by examiner

*Primary Examiner* — Matthew D Troutman
(74) *Attorney, Agent, or Firm* — Hamre, Schumann, Mueller & Larson, P.C.

(57) ABSTRACT

A lip for excavator buckets that is manufactured of rolled steel which gives it better mechanical properties than cast lips, achieving a better weight and decreasing manufacturing times. The lip has a machined slot formed in each nose. The slots allow the deformity and wear of the noses to be verified, facilitating repair operations.

11 Claims, 3 Drawing Sheets

ROLLED STEEL LIP FOR AN EXCAVATOR BUCKET

FIELD OF APPLICATION OF THE INVENTION

This description relates to a lip or edge for excavator buckets used in earth movement machinery, especially in the field of mining.

BACKGROUND

The excavator buckets have elements mounted on the ground contact surface of these buckets, which are generally comprised of a lip, adapters, teeth, and a lock that secures the tooth to the adapter; the lip is welded to the edge of the bucket, and the teeth and adapters are secured on the other end. These elements that are mounted on the excavator part submitted to contact with the ground and that allow the pieces submitted to wear to be exchanged are of great use since it is only necessary to change those parts submitted to wear when required, with operations that only imply assembling or disassembling these pieces without the need for welding, which involves stoppage time of the equipment, which affects operations. The lip also suffers wear after the replaceable elements mentioned previously are changed several times; in these cases it is necessary to remove the lip and weld a new one.

In prior art, lips for excavators are manufactured from cast steel alloys, which are very heavy and have a long manufacturing process.

DETAILED DESCRIPTION OF THE INVENTION

Figure 1:
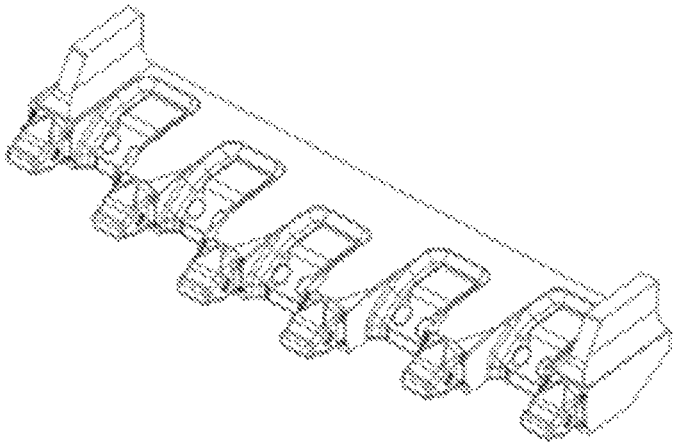
FIGURE 1 Prior Art
FIG. 1 shows a prior art cast lip.
Figure 2:
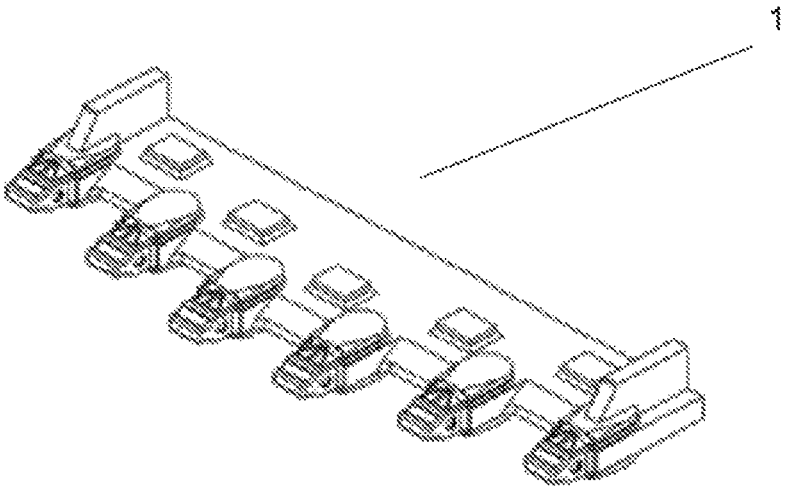
FIG. 2 shows the rolled steel lip of the invention.
Figure 3:
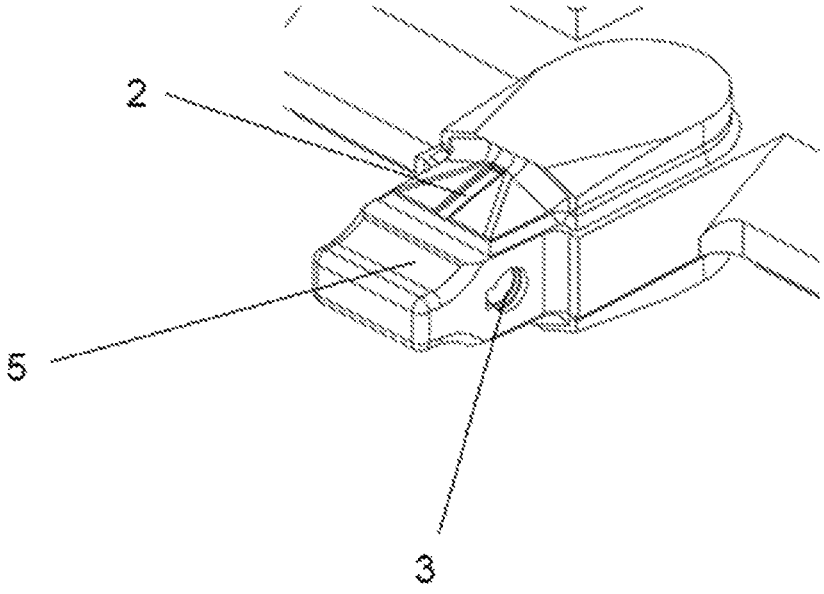
FIG. 3 shows a detail of the slot for the measurement of deformity and wear.
Figure 4:
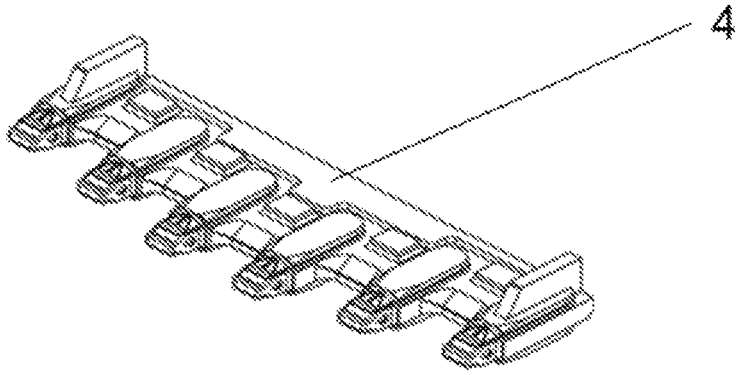
FIG. 4 shows a lip with a shroud.
Figure 5:
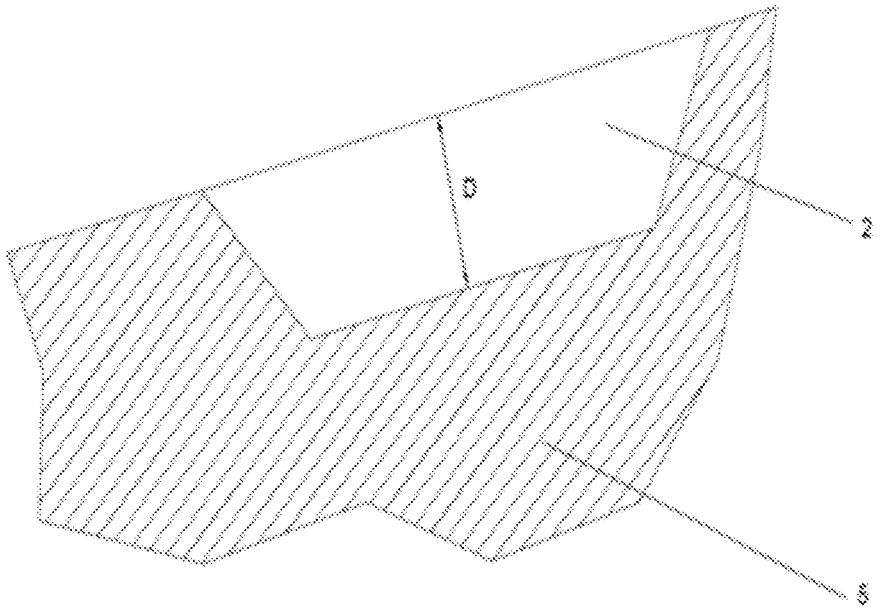
FIG. 5 is a cross-sectional view of the slot showing its depth.

With reference to FIGS. 2-5, this use model comprises a lip (1) for excavators manufactured of rolled steel which gives it better mechanical properties than cast lips, achieving a better weight. It must also be mentioned that manufacturing times decrease from 6 months to one month since foundries have a high workload which delays production.

The lip has a machined slot (2) formed in each nose (5). A machined slot is a slot that has been obtained by machining, instead of a cast slot formed during casting of a cast lip. The slots (2) allow the deformity and wear of the noses to be verified, facilitating repair operations. In particular, each slot (2) is located in a zone where the nose (5) suffers deformity and wear due to the direct contact with the adapter. The slots (2) can be located at any location on the noses that are subject to deformity and wear. Preferably, the slot is formed on the top surface of each nose (5), although the slot can be formed on the bottom surface, on one of the side surfaces, or on another surface of the nose. The depth (D) of the slot (2) is known, and as the nose deforms and wears, the depth (D) is reduced. If the depth of the slot reaches a determined value, that indicates that the nose should be repaired.

The lip (1) has perforations (3) in the noses (5) to allow the adaptors of the excavator bucket's teeth to be secured. The noses (5) are located at the front of the lip, tooth adapters are installed in said noses and in turn the teeth are installed on said tooth adapters. Adapters and teeth are known external elements that are not shown in the figures Since it has a low weight due to its construction in rolled steel, the lip (1) has the option of a layer of armor steel (4), which further increases the useful life of this lip. This layer of armor steel can be considered to be a replacement part kit, which is comprised of a set of panels that can be replaced. In the case of the cast product this is not feasible, and repair in this case consists of filling with solder, which has a shorter duration than the original component. In the case of the replacement kit, it is changed before damage is produced to the base panel; the duration of this armor steel layer kit is the same as the original base panel of the lip of this invention and it is longer than the duration of the cast lip since there armor steel is used.

The invention claimed is:

1. A lip for an excavator bucket, wherein:

the lip is manufactured from a single piece of rolled steel, the lip includes a plurality of noses formed at a front end thereof as part of the single piece construction, and a machined slot is formed in at least one of the noses, the slot has a longitudinal axis that extends in a forward/backward direction parallel to a forward/backward axis of the nose it is formed in, and the slot has an axial length measured along the longitudinal axis that is longer than its width;

a perforation formed in the one nose; and a tooth adapter secured on the one nose via the perforation, the machined slot is formed in the one nose at a location where the nose suffers deformity and wear due to contact with the tooth adapter.

2. The lip for an excavator bucket according to claim 1, wherein the lip has a layer of armor steel disposed on an upwardly facing surface thereof behind the one nose.

3. The lip for an excavator bucket according to claim 2, wherein the layer of armor steel is replaceable.

4. The lip for an excavator bucket according to claim 2, wherein the layer of armor steel is part of a replacement kit that is comprised of a set of panels.

5. The lip for an excavator bucket according to claim 1, further comprising a tooth installed on the tooth adapter.

6. A lip for an excavator bucket, comprising:

the lip is manufactured of a single piece of rolled steel;

a plurality of noses formed at a front end of the lip as part of the single piece construction, each nose includes a machined slot formed in a surface thereof, each slot having a predetermined depth, each slot has a longitudinal axis that extends in a forward/backward direction parallel to a forward/backward axis of the respective nose it is formed in, and each slot has an axial length measured along the longitudinal axis that is longer than its width;

a perforation formed in each nose;

a tooth adapter secured on each nose via the respective perforation, each of the machined slots is formed in each nose at a location where the respective nose suffers deformity and wear due to contact with the respective tooth adapter.

7. The lip for an excavator bucket according to claim 6, wherein each of the slots is formed in a top surface of the respective nose, each slot has a sloped front wall and a sloped rear wall, and each slot has a constant depth portion between the sloped front wall and the sloped rear wall.

8. The lip for an excavator bucket according to claim 6, further comprising a layer of armor steel secured to the lip on an upwardly facing surface thereof behind the noses.

9. The lip for an excavator bucket according to claim 8, wherein the layer of armor steel is detachably connected to the lip.

10. The lip for an excavator bucket according to claim 8, wherein the layer of armor steel comprises a plurality of panels.

11. The lip for an excavator bucket according to claim 6, further comprising a tooth installed on each tooth adapter.

* * * * *